US006564566B2

(12) United States Patent
Kim et al.

(10) Patent No.: US 6,564,566 B2
(45) Date of Patent: May 20, 2003

(54) COOLING AIR CIRCULATING DEVICE IN REFRIGERATOR

(75) Inventors: Sang Bae Kim, Changwon (KR); Young Seok Choi, Changwon (KR); Byung Gyu Kang, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/036,381

(22) Filed: Jan. 7, 2002

(65) Prior Publication Data

US 2003/0041616 A1 Mar. 6, 2003

(30) Foreign Application Priority Data

Aug. 31, 2001 (KR) ..... 2001-53400
Aug. 31, 2001 (KR) ..... 2001-53407
Aug. 31, 2001 (KR) ..... 2001-53419

(51) Int. Cl.[7] ..... A47F 3/04

(52) U.S. Cl. ..... 62/225; 62/407; 62/412; 62/414; 62/426; 62/440

(58) Field of Search ..... 62/407, 412, 414, 62/255, 426, 419, 411, 440

(56) References Cited

U.S. PATENT DOCUMENTS 4,369,632 A * 1/1983 Abraham ..... 62/256
4,722,200 A 2/1988 Frohbieter ..... 62/382
4,834,169 A 5/1989 Tershak et al. ..... 165/30
5,355,686 A 10/1994 Weiss ..... 62/89
5,729,997 A 3/1998 Witsoe ..... 62/407
5,765,388 A * 6/1998 Jeon ..... 62/408
5,775,124 A * 7/1998 Park et al. ..... 62/408
5,816,068 A 10/1998 Oh et al. ..... 62/407
5,960,641 A * 10/1999 Kim et al. ..... 62/404
6,012,384 A * 1/2000 Badalament et al. ..... 62/329
6,032,480 A * 3/2000 Kim ..... 62/187
6,041,616 A * 3/2000 Jeong ..... 62/256
6,347,530 B1 * 2/2002 Kim ..... 62/407
6,381,982 B1 * 5/2002 Kim ..... 62/407

FOREIGN PATENT DOCUMENTS

GB 1176504 1/1970
GB 1444630 8/1976

* cited by examiner

*Primary Examiner*—William E. Tapolcai
*Assistant Examiner*—Mohammad M. Ali
(74) *Attorney, Agent, or Firm*—Fleshner & Kim, LLP

(57) ABSTRACT

A cooling air circulating device of a refrigerator is provided. According to the cooling air circulating device, it is possible to impartially cool a chilling chamber and to make the spread of temperature of the chilling chamber uniform by letting cooling air sucked up into the respective cells divided by shelves of the chilling chamber. Also, it is possible to rapidly cool the chilling chamber and to reduce time for cooling the chilling chamber by minimizing time, for which the cooling air whose temperature has risen above a predetermined temperature stays in the chilling chamber. A cooling air circulating device of a refrigerator includes a cooling air supply path formed on one side of a mullion wall for separating a freezing chamber from the chilling chamber, the cooling air supply path for supplying cooling air to the chilling chamber, a discharge duct connected to the cooling air supply path, the discharge duct for discharging the cooling air to the chilling chamber, and a cooling air suction duct formed on one surface or both surfaces of the chilling chamber, the cooling air suction duct for sucking up the cooling air that completed a cooling operation while circulating in the chilling chamber.

19 Claims, 13 Drawing Sheets

COOLING AIR CIRCULATING DEVICE IN REFRIGERATOR

BACKGROUND OF THE INVENTION

1. Field of the Invention

The present invention relates to a cooling air circulating device in a refrigerator, and more particularly, to a cooling air circulating device in a refrigerator, which is capable of impartially supplying cooling air to a chilling chamber and uniformly maintaining the spread of temperature of the chilling chamber.

2. Description of the Background Art

In general, a refrigerator is divided into a freezing chamber for keeping an ice making container and frozen food and a chilling chamber for keeping cold food. The refrigerator includes a freezing cycle for supplying cooling air to the freezing chamber and the chilling chamber.

A common type refrigerator, where the freezing chamber and the chilling chamber are arranged in a vertical direction, and a side-by-side type refrigerator having a large capacity, where the freezing chamber and the chilling chamber are arranged in a horizontal direction, are mainly used.

FIG. 1 is a vertical sectional view showing a cooling air supplying device of a side-by-side type refrigerator according to a conventional technology. FIG. 2 is a horizontal sectional view showing the cooling air supplying device of the side-by-side type refrigerator according to the conventional technology.

A conventional refrigerator includes a main frame 104, in which a pair of doors 102 hi-directionally opened and closed are installed in the front portion and a receipt space is included, a freezing chamber 106 arranged on either the left side or the right side of the main frame 104, the freezing chamber 106 for keeping frozen food, a chilling chamber 108 separated from the chilling chamber 106 by a mullion wall 110 and arranged on the other side of the main frame 104, the chilling chamber 108 keeping cold food, a blast fan 115 installed in the upper portion of the freezing chamber 106, the blast fan 115 for forcibly blowing air frozen while passing through the evaporator 112 of the freezing cycle to the freezing chamber 106, and a chilling chamber cooling air circulating device for supplying the cooling air blown by the blast fan 115 to the chilling chamber 108.

A plurality of shelves 114 are installed to be separated from each other by a predetermined distance in the freezing chamber 106 and the chilling chamber. 108 so that food can be kept by layers. Vegetable boxes 116 and 117 for keeping vegetables are bedded in the lower portion of the shelves 114.

The chilling chamber cooling air circulating device includes a cooling air supply path 118 formed in the upper portion of the mullion wall 110 so as to suck up the cooling air blown from the blast fan 115 installed in the freezing chamber 106 into the chilling chamber 108, a cooling air discharge duct 120 installed in the upper portion of the chilling chamber 108 and connected to the cooling air supply path 118, the cooling air discharge duct 120 for discharging the cooling air supplied to the cooling air supply path 118 to the chilling chamber 108, and a cooling air suction path 122 formed in the lower portion of the mullion wall 110, the cooling air suction path 122 for sucking up the cooling air that completed a cooling operation while circulating in the chilling chamber 108 into the freezing cycle.

The cooling air discharge duct 120 is horizontally arranged in the upper portion of the chilling chamber 108.

One side of the cooling air discharge duct 120 connected to the cooling air supply path 118. A plurality of cooling air discharge openings 124 for discharging the cooling air to the chilling chamber 108 are formed in the front portion.

As shown in FIG. 3, the plurality of vegetable boxes 116 and 117 can be bedded in the lower portion of the chilling chamber by layers. The cooling air suction path 122 is formed in a predetermined position of the mullion wall 110 separated from the bottom of the chilling chamber by a predetermined distance.

That is, the cooling air suction path 122 is formed in one surface of the vegetable box 116 bedded in the upper portion among the vegetable boxes 116 and 117 bedded by layers. A deodorant 140 for removing the bad smell of the cooling air sucked up from the chilling chamber into the freezing cycle is installed in the cooling air suction path 122.

According to the conventional side-by-side type refrigerator having the above structure, when the freezing cycle is driven and a blast fan 115 is rotated, the air frozen while passing through the evaporator 112 is discharged into the freezing chamber 106 by the blast pressure of the blast fan 115 and is supplied to the chilling chamber through the cooling air supply path 118.

The cooling air supplied to the cooling air supply path 118 is sucked up into the cooling air discharge duct 120 and is discharged into the chilling chamber 108 through the cooling air discharge openings 124 formed in the cooling air discharge duct 120. The cooling air discharged into the chilling chamber 108 cools the cold food kept in the chilling chamber 108 while circulating in the chilling chamber 108. The cooling air that completed the cooling operation is sucked up into a cooling cycle through the cooling air suction path 122 formed in the lower portion of the mullion wall 110 and is cooled again while passing through the evaporator 112.

However, according to the chilling chamber cooling air circulating device of the above conventional refrigerator, since the path, through which the cooling air that completed the cooling operation while circulating in the chilling chamber is sucked up into the freezing cycle, is formed in the lower portion of the mullion wall, it takes longer to suck up the cooling air that completed the cooling operation. Accordingly, the cooling air whose temperature has risen above a predetermined temperature stays longer in the chilling chamber. Therefore, the cooling air is not impartially distributed to the chilling chamber. As a result, the chilling chamber is partially cooled. Accordingly, the spread of temperature of the chilling chamber is not uniform.

In particular, since only one cooling suction path exists, the cooling air cannot smoothly circulate in the chilling chamber and the temperature of the cooling air discharged from the upper portion of the chilling chamber rises toward the lower portion of the chilling chamber. Accordingly, the food stored in the upper portion of the chilling chamber is excessively cooled and the food stored in the lower portion of the chilling chamber is weakly cooled.

Also, the cooling air suction path, through which the cooling air that circulated in the chilling chamber is sucked up, is formed in the lower portion of the mullion wall so as to be separated from the bottom of the chilling chamber by a predetermined distance, the cooling air does not reach the vegetable box bedded in the lower portion of the chilling chamber. Accordingly, the cooling of the vegetable box deteriorates.

Also, the deodorization effect of the deodorant installed on the cooling air suction path increases in proportion to the amount of air that passes through the cooling air suction path. Since the size of the cooling air suction path is small, the size of the deodorant becomes small. Therefore, the deodorization effect of the deodorant deteriorates.

SUMMARY OF THE INVENTION

Therefore, an object of the present invention is to provide a cooling air circulating device of a refrigerator, which is capable of impartially cooling an entire chilling chamber and making the spread of temperature of the chilling chamber uniform by letting cooling air sucked up into the respective cells divided by the shelves of the chilling chamber.

Another object of the present invention is to provide a cooling air circulating device of a refrigerator, which is capable of rapidly cooling food and reducing time for cooling the food by letting the cooling air sucked up into the respective cells of the chilling chamber, to thus minimize time, for which the cooling air whose temperature has risen above a predetermined temperature stays in the chilling chamber.

Another object of the present invention is to provide a cooling air circulating device of a chilling chamber, which is capable of smoothly cooling a vegetable box by circulating the cooling air in the lower portion of the chilling chamber, where the vegetable box is bedded.

Another object of the present invention is to provide a cooling air circulating device of a refrigerator, which is capable of increasing the deodorization effect of a deodorant by increasing the area of the deodorant for removing the bad smell of the chilling chamber.

To achieve these and other advantages and in accordance with the purposes of the present invention, as embodied and broadly described herein, there is provided a cooling air circulating device of a refrigerator, comprising a cooling air supply path formed on one side of a mullion wall for separating a freezing chamber from a chilling chamber, the cooling air supply path for supplying cooling air to the chilling chamber, a discharge duct connected to the cooling air supply path, the discharge duct for discharging the cooling air to the chilling chamber, and a cooling air suction duct formed on one surface or both surfaces of the chilling chamber, the cooling air suction duct for sucking up the cooling air that completed a cooling operation while circulating in the chilling chamber.

A cooling air circulating device of a refrigerator according to the present invention comprises a cooling air supply path formed in the upper portion of a mullion wall for separating a freezing chamber from a chilling chamber, the cooling air supply path for supplying cooling air to the chilling chamber, an upper discharge duct connected to the cooling air supply path and installed in the upper portion of the chilling chamber, the upper discharge duct for discharging the cooling air from the upper side of the chilling chamber, a side surface discharge duct connected to the upper discharge duct and vertically installed on the left side of the chilling chamber, the side surface discharge duct for discharging the cooling air into the respective cells divided by shelves, and a cooling air suction duct vertically installed on the right surface of the chilling chamber, the cooling air suction duct for sucking up the cooling air into the respective cells divided by the shelves.

A cooling air circulating device of a refrigerator according to the present invention comprises a cooling air supply path formed in the upper portion of a mullion wall for separating a freezing chamber from a chilling chamber, the cooling air supply path for supplying cooling air to the chilling chamber, an upper discharge duct connected to the cooling air supply path and installed in the upper portion of the chilling chamber, the upper discharge duct for discharging the cooling air from the upper portion of the chilling chamber, a side surface discharge duct connected to the upper discharge duct and vertically installed on the right side of the chilling chamber, the side surface discharge duct for discharging the cooling air into the respective cells divided by shelves, and a cooling air suction duct vertically installed on the left surface of the chilling chamber, the cooling air suction duct for sucking up the cooling air into the respective cells divided by the shelves.

A cooling air circulating device of a refrigerator according to the present invention comprises a cooling air supply path formed in the upper portion of a mullion wall for separating a freezing chamber from a chilling chamber, the cooling air supply path for supplying cooling air to the chilling chamber, an upper discharge duct connected to the cooling air supply path and installed in the upper portion of the chilling chamber, the upper discharge duct for discharging the cooling air from the upper portion of the chilling chamber, and cooling air suction ducts connected to the upper discharge duct and vertically installed on the left and right surfaces of the chilling chamber, the cooling air suction ducts for sucking up the cooling air into the respective cells divided by shelves.

The cooling air suction duct is vertically formed on the side surface of the chilling chamber and a plurality of cooling air suction openings are formed in the cooling air suction duct to be separated from each other by a predetermined distance so that the cooling air can be sucked up into the respective cells divided by the shelves.

A cooling air movement path for moving the cooling air sucked up into the cooling air suction openings to the cooling air guide path is connected in the lower portion of the cooling air suction duct.

A cooling air circulating device of a refrigerator according to the present invention comprises a cooling air supply path formed in the upper portion of a mullion wall so as to supply cooling air blown from a blast fan to a chilling chamber, a discharge duct for discharging the cooling air supplied from the cooling air supply path into the chilling chamber, a cooling air suction unit installed on the bottom of the chilling chamber, the cooling air suction unit for sucking up the cooling air discharged from the discharge duct via vegetable boxes, and a cooling air guide path for guiding the cooling air sucked up into the cooling air suction means to a freezing cycle.

The cooling air suction unit is installed on the bottom of the chilling chamber and is formed of a flat plate type cooling air suction duct, around which a plurality of cooling air suction openings for sucking up the cooling air are formed.

A cooling air movement duct connected to the cooling air guide path, the cooling air movement duct for moving the cooling air sucked up into the cooling air suction duct to the cooling air guide path is formed in the upper portion of the cooling air suction duct.

The cooling air suction duct is formed of a box that can be opened and closed and a deodorant for removing the bad smell of the cooling air is loaded in the cooling air suction duct.

The deodorant is formed in a predetermined flat plate type so that the deodorant can be settled in the cooling air suction duct and a plurality of through holes, through which the cooling air sucked up into the cooling air suction duct passes and is deodorized, are formed in the deodorant.

A cooling air circulating device of a refrigerator according to the present invention comprises a cooling air supply path formed in the upper portion of a mullion wall for separating a freezing chamber from a chilling chamber, the cooling air supply path for supplying cooling air to the chilling chamber, a cooling air discharge duct connected to the cooling supply path, the cooling air discharge duct for discharging the cooling air into the chilling chamber, a cooling air suction path for sucking up the cooling air that completed a cooling operation while circulating the chilling chamber, and a suction unit installed on the cooling air suction path, the suction unit for providing a suction pressure so that the cooling air can be smoothly sucked up.

The suction unit is formed of a suction fan for providing the suction pressure when the cooling air that completed the cooling operation while circulating in the chilling chamber is sucked up into the cooling air suction path.

A cooling air circulating device of a refrigerator according to the present invention comprises a cooling air supply path formed in the upper portion of a mullion wall for separating a freezing chamber from a chilling chamber, the cooling air supply path for supplying cooling air to the chilling chamber, a cooling air discharge duct connected to the cooling air supply path, the cooling air discharge duct for discharging the cooling air into the chilling chamber, a cooling air suction path for sucking up the cooling air that completed a cooling operation while circulating in the chilling chamber, and a cooling air guide unit formed on the cooling air suction path, the cooling air guide unit for guiding the flow of the cooling air so that the cooling air can be sucked up into the cooling air suction path via vegetable boxes.

The cooling air guide unit is formed of a cooling air guide duct extended from the front portion of the cooling air suction path, the cooling air guide duct for guiding the direction, in which the cooling air is sucked up, so that the cooling air can circulate around the vegetable boxes.

The cooling air guide duct comprises a first suction opening formed between the vegetable boxes so that the cooling air circulating around the vegetable box positioned in the upper portion is sucked up and a second suction opening formed in a position close to the bottom of the chilling chamber so that the cooling air circulating around the vegetable box positioned in the lower most portion of the chilling chamber is sucked up.

A cooling air circulating device of a refrigerator according to the present invention comprises a cooling air supply path formed in the upper portion of a mullion wall for separating a freezing chamber from a chilling chamber, the cooling air supply path for supplying cooling air to the chilling chamber, a cooling air discharge duct connected to the cooling air supply path, the cooling air discharge duct for discharging the cooling air into the chilling chamber, a cooling air suction path for sucking up the cooling air that completed a cooling operation while circulating in the chilling chamber, a cooling air suction duct formed in the front portion of the cooling air suction path, the cooling air suction duct for guiding the flow of the cooling air so that the cooling air can be sucked up into the cooling air suction path via vegetable boxes, and a suction fan loaded in the cooling air suction path, the suction fan for providing suction pressure to the sucked cooling air.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

An embodiment of a cooling air circulating device of a refrigerator according to the present invention will now be described with reference to the attached drawings.

A plurality of embodiments of the cooling air circulating device of the refrigerator according to the present invention can exist. However, a preferred embodiment will now be described.

Figure 1:
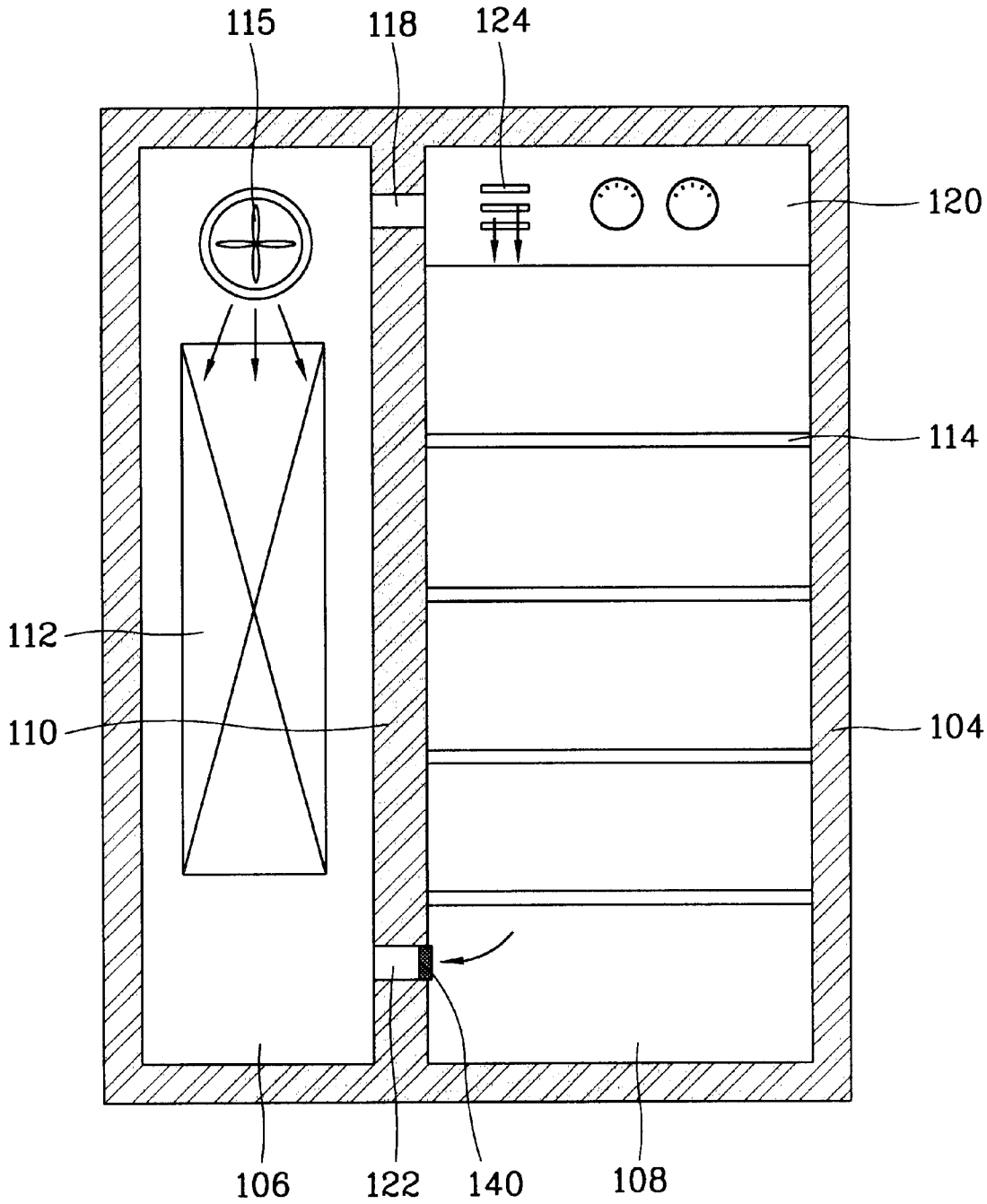
FIG. 1 PRIOR ART
FIG. 1 is a vertical sectional view showing a cooling air circulating device of a refrigerator according to a conventional technology.
Figure 2:
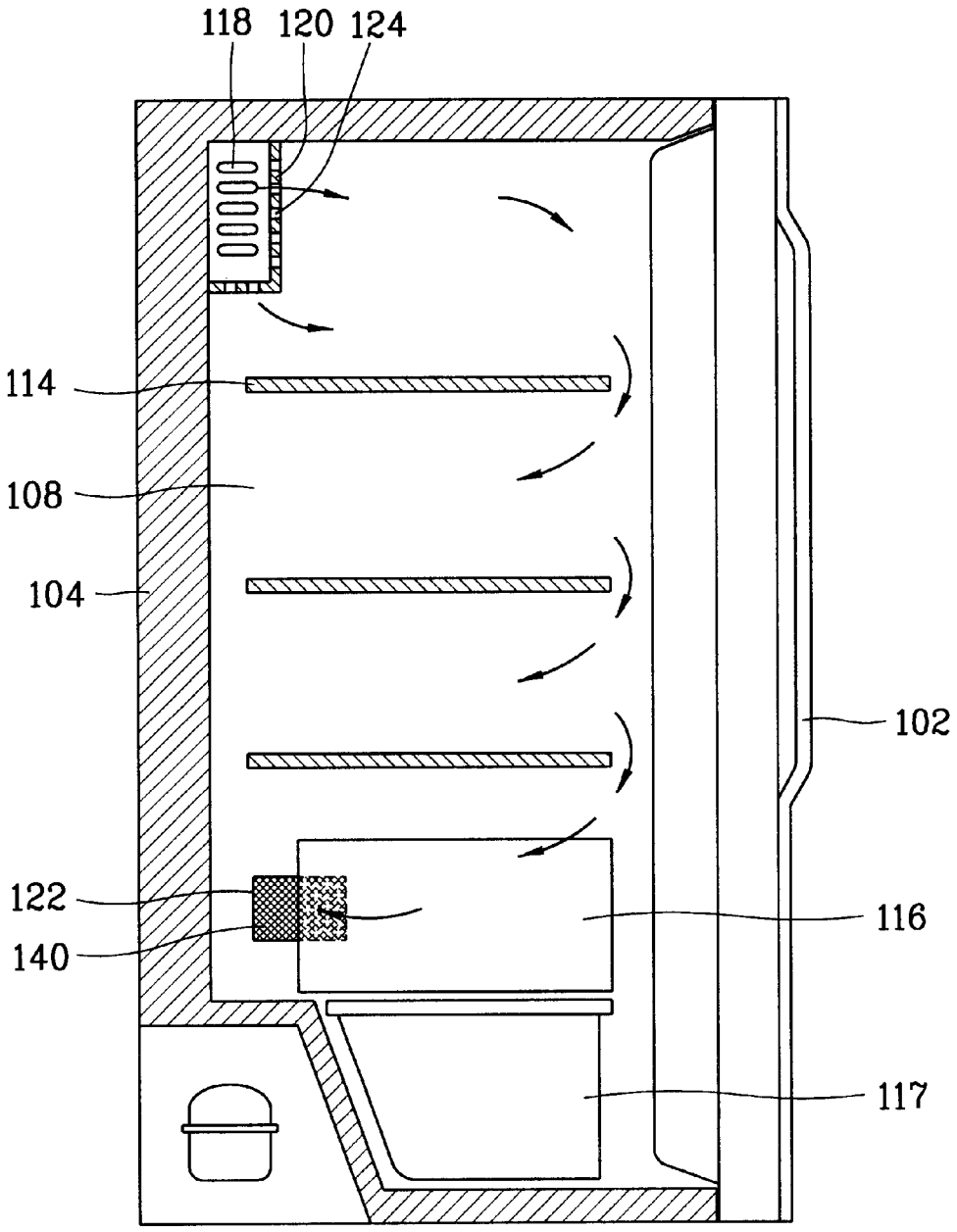
FIG. 2 PRIOR ART
FIG. 2 is a horizontal sectional view showing the cooling air circulating device of the refrigerator according to the conventional technology.
Figure 3:
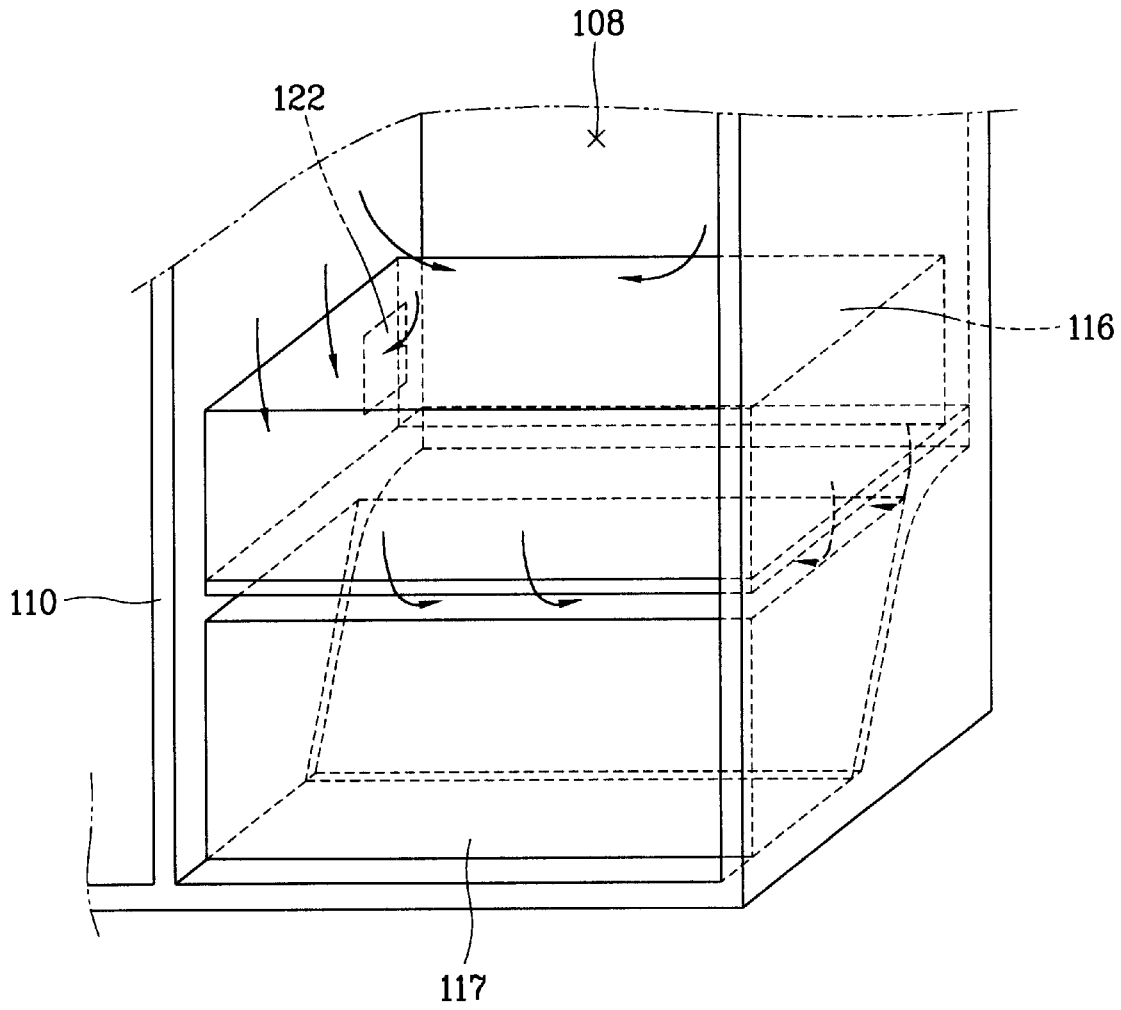
FIG. 3 PRIOR ART
FIG. 3 is a partially cut perspective view showing the cooling air circulating device of the refrigerator according to the conventional technology.
Figure 4:
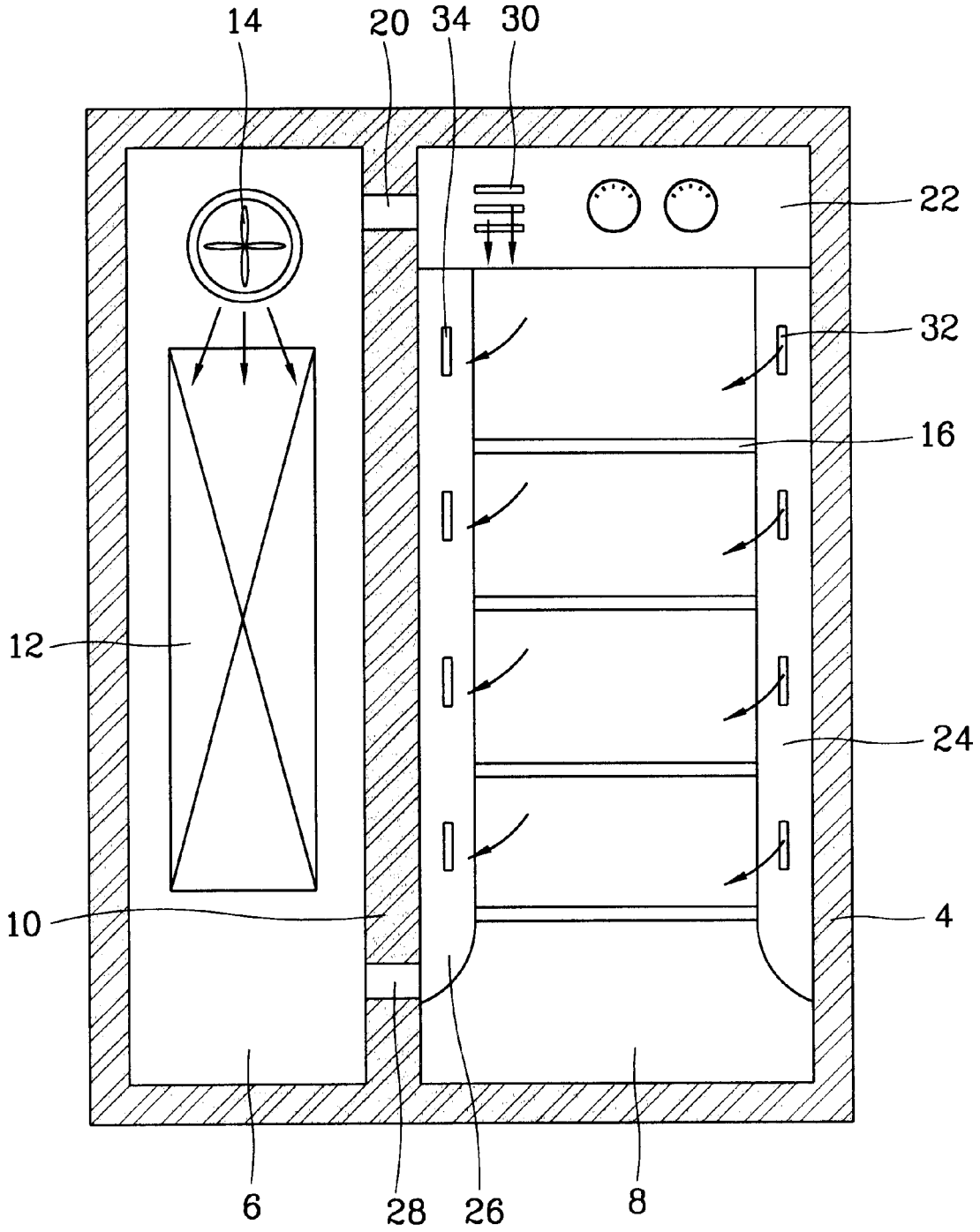
FIG. 4 is a vertical sectional view showing a cooling air circulating device of a refrigerator according to an embodiment of the present invention.
Figure 5:
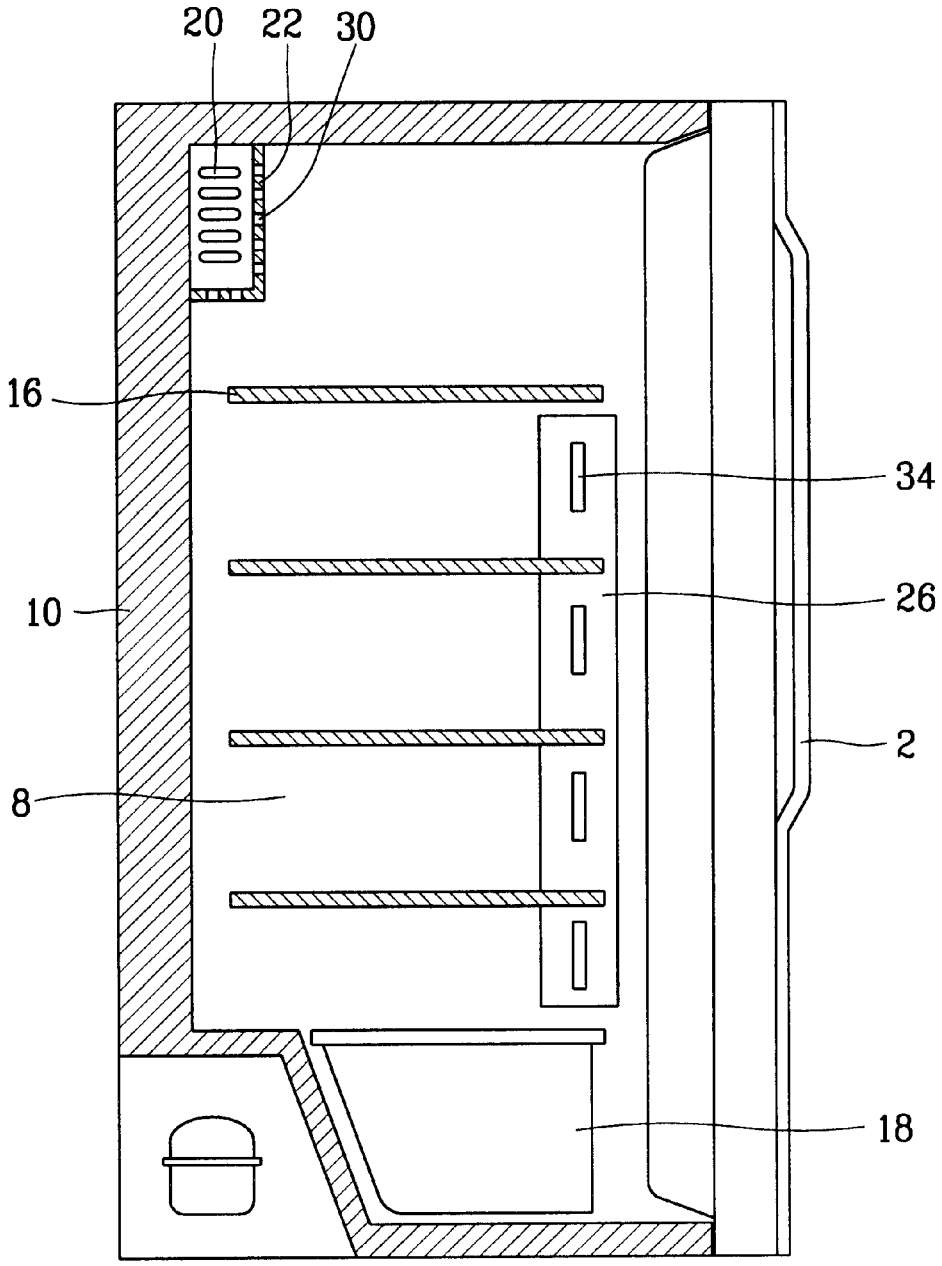
FIG. 5 is a horizontal sectional view showing the cooling air circulating device of the refrigerator according to the embodiment of the present invention.

FIG. 4 is a vertical sectional view showing a cooling air circulating device of a refrigerator according to an embodiment of the present invention. FIG. 5 is a horizontal vertical view showing the cooling air circulating device of the refrigerator according to the embodiment of the present invention.

A refrigerator according to the present invention includes a main frame 4, in which a door 2 bi-directionally opened and closed is installed on an opened front side and which has a receipt space for storing food, a freezing chamber 6 formed on either the left side or the right side of the main frame 4, the freezing chamber 6 for storing frozen food, a chilling chamber 8 separated from the freezing chamber 6 by a mullion wall 10 and formed on the opposite side of the freezing chamber 6, a freezing cycle (not shown) installed on one side of the main frame 4, the freezing cycle for generating cooling air, a blast fan 14 for supplying the air cooled while passing through the evaporator 12 of the freezing cycle to the freezing chamber 6, and a chilling chamber cooling air circulating device for circulating the air cooled while passing through the evaporator 12 in the chilling chamber 8.

Shelves 16, in which food is bedded, is installed in the chilling chamber 8 to be separated from each other by a predetermined distance. A vegetable box 18 for storing vegetables is bedded in the lower portion of the chilling chamber 8.

As shown in FIGS. 4 and 5, a chilling chamber cooling air circulating device according to an embodiment of the present invention includes a cooling air supply path 20 formed in the upper portion of the mullion wall 10, the cooling air supply path 20 for supplying the cooling air blown by the blast fan 14 to the chilling chamber 8, an upper discharge duct 22 connected to the cooling air supply path 20 and installed in the upper portion of the chilling chamber 8, the upper discharge duct 22 for discharging the cooling air in the upper portion of the chilling chamber 8, a side surface discharge duct 24 connected to the upper discharge duct 22 and installed on either the left side surface or the right side surface of the chilling chamber 8, the side surface discharge duct 24 for discharging the cooling air into the respective cells divided by the shelves 16, and a cooling air suction duct 26 installed on the other side wall of the chilling chamber 8, the cooling air suction duct 26 for sucking up the cooling air into the respective cells divided by the shelves 16.

A cooling air guide path 28 connected to the cooling air suction duct 26, the cooling air guide path 28 for guiding the cooling that completed a cooling operation to the evaporator 12 of the freezing cycle, is installed in the lower portion of the mullion wall 10.

A plurality of discharge openings 30 for discharging the cooling air into the upper portion of the chilling chamber 8 is formed in the front portion of the discharge duct 22. A plurality of discharge openings 32 for discharging the cooling air into the respective cells is formed in the front portion of the side surface discharge duct 24.

The side surface discharge duct 24 is vertically formed on the right side wall of the chilling chamber 8, to thus discharge the cooling air into the respective cells from the right side.

The cooling air suction duct 26 is vertically formed on the left sidewall of the chilling chamber 8. A plurality of cooling air suction openings 34 are formed in the cooling air suction duct 26 to be separated from each other by a predetermined distance so that the respective cells divided by the shelves 16 can suck up the cooling air. The lower portion of the cooling air suction duct 26 is connected to the cooling air guide duct 28 so that the cooling air sucked up into the plurality of cooling air suction openings 34 is guided to the evaporator 12 of the freezing cycle through the cooling air guide path 28.

The operation of the cooling air circulating device of the refrigerator according to the present invention, which has the above structure, will now be described.

When power is applied to the refrigerator, the freezing cycle is operated and the blast fan 14 is driven. Accordingly, the air cooled while passing through the evaporator 12 of the freezing cycle is respectively supplied to the freezing chamber 6 and the chilling chamber 8, to thus perform the cooling operation. The air that completed the cooling operation is sucked up into the freezing cycle again. The above processes are repeated.

The cooling air sucked up from the blast fan 14 into the cooling air supply path 20 is supplied to the upper discharge duct 22 and is discharged into the upper portion of the chilling chamber 8 through the discharge openings 30 formed in the front portion of the upper discharge duct 22. The cooling air supplied to the upper discharge duct 22 is supplied to the side surface discharge duct 24 installed on the right wall of the chilling chamber 8 and is discharged into the respective cells divided by the shelves 16 through the plurality of discharge openings 32.

The cooling air discharged from the upper discharge duct 22 and the side surface discharge duct 24 completes the cooling operation while circulating in the chilling chamber 8, is sucked up into the cooling air suction openings 34 of the cooling air suction duct 26 installed on the left wall of the chilling chamber 8, and moves to the evaporator 12 of the freezing cycle through the cooling air guide path 28.

The cooling air suction openings 34 are formed in the respective cells divided by the shelves 16, to thus suck up the cooling air that completed the cooling operation. Accordingly, the cooling air is rapidly sucked up and time, for which the cooling air stays in the chilling chamber, is reduced. Therefore, it is possible to improve cooling efficiency.

The cooling air suction duct can be installed on the right wall of the chilling chamber, which is opposite to the side, on which the cooling air suction duct described in the above embodiment is installed. It is possible to obtain the same effect as the effect of the cooling air circulating, device described in the above embodiment by the cooling air suction duct.

Figure 6:
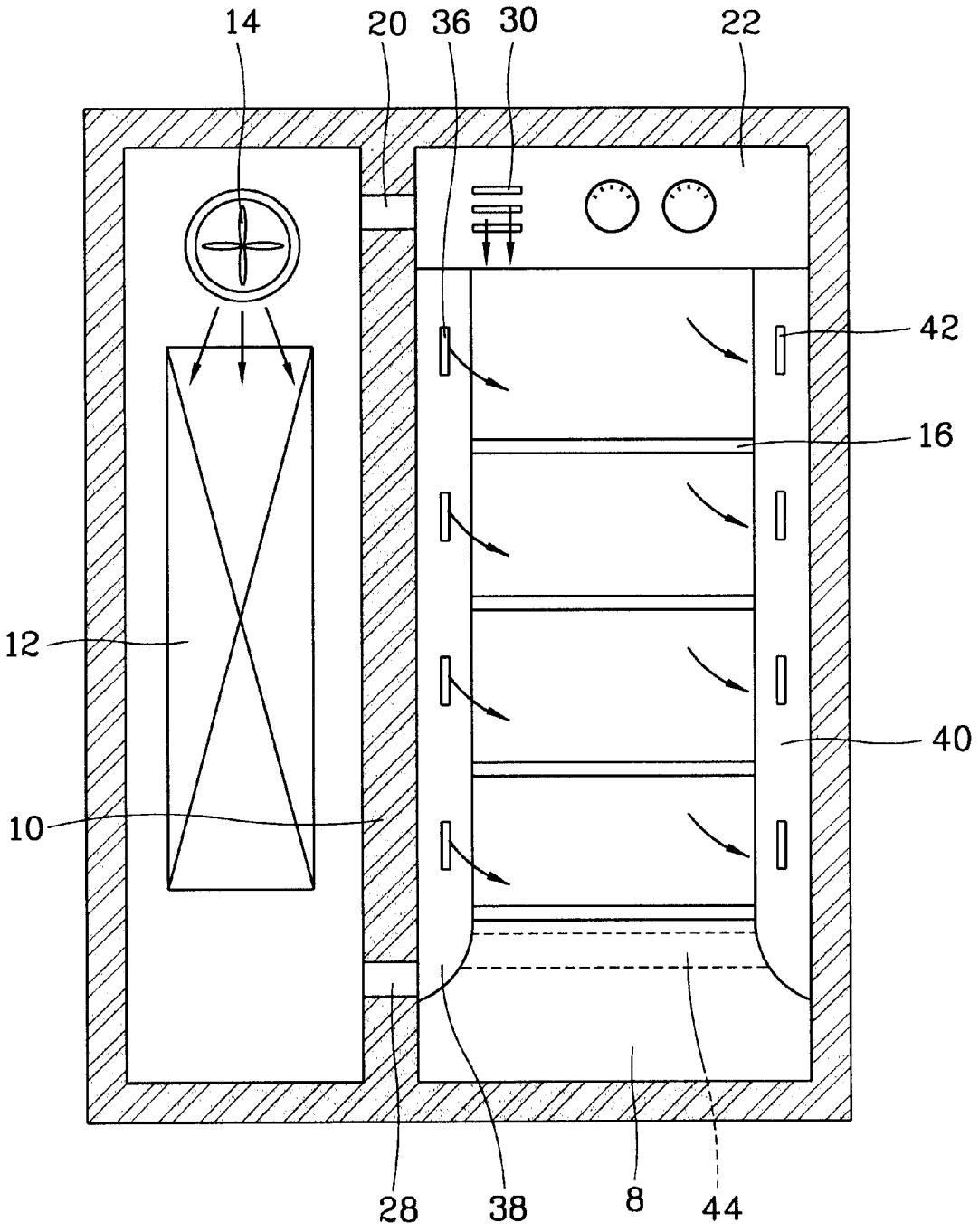
FIG. 6 is a horizontal sectional view showing a cooling air circulating device of a refrigerator according to a second embodiment of the present invention.

As shown in FIG. 6, in a cooling air circulating device according to a second embodiment, a side surface discharge duct 38 installed on the left wall of the chilling chamber 8 and having a plurality of discharge openings 36 is vertically installed. A cooling air suction duct 40 for sucking up the cooling air that completed the cooling operation while circulating in the chilling chamber 8 is installed on the right wall of the chilling chamber 8.

A plurality of cooling air suction openings 42 for sucking up the cooling air into the respective cells are formed in the cooling air suction duct 40. A cooling air movement path 44 is connected between the lower portion of the cooling air suction duct 40 and the cooling air guide path 28 formed in the mullion wall 10 so that the cooling air sucked up into the cooling air suction openings 42 of the cooling air suction duct 40 moves to the cooling air guide duct 28.

In the cooling air circulating device according to the second embodiment, the cooling air is discharged from the upper portion and the side surface of the chilling chamber 8 through the upper discharge duct 22 and the side surface discharge duct 38 and performs the cooling operation while circulating in the chilling chamber 8. The cooling air that completed the cooling operation is sucked up into the respective cells divided by the shelves 16 through the cooling air suction openings 42 of the cooling air suction duct 40 installed on the right side of the chilling chamber 8. The cooling air sucked up into the cooling air suction duct 40 moves to the cooling air guide path 28 through the cooling air movement path 44 and is guided to the evaporator 12 of the cooling cycle.

The cooling air suction duct can be installed on the left and right walls of the chilling chamber 8 so that the cooling air can be sucked up into the left and right walls of the chilling chamber 8.

Figure 7:
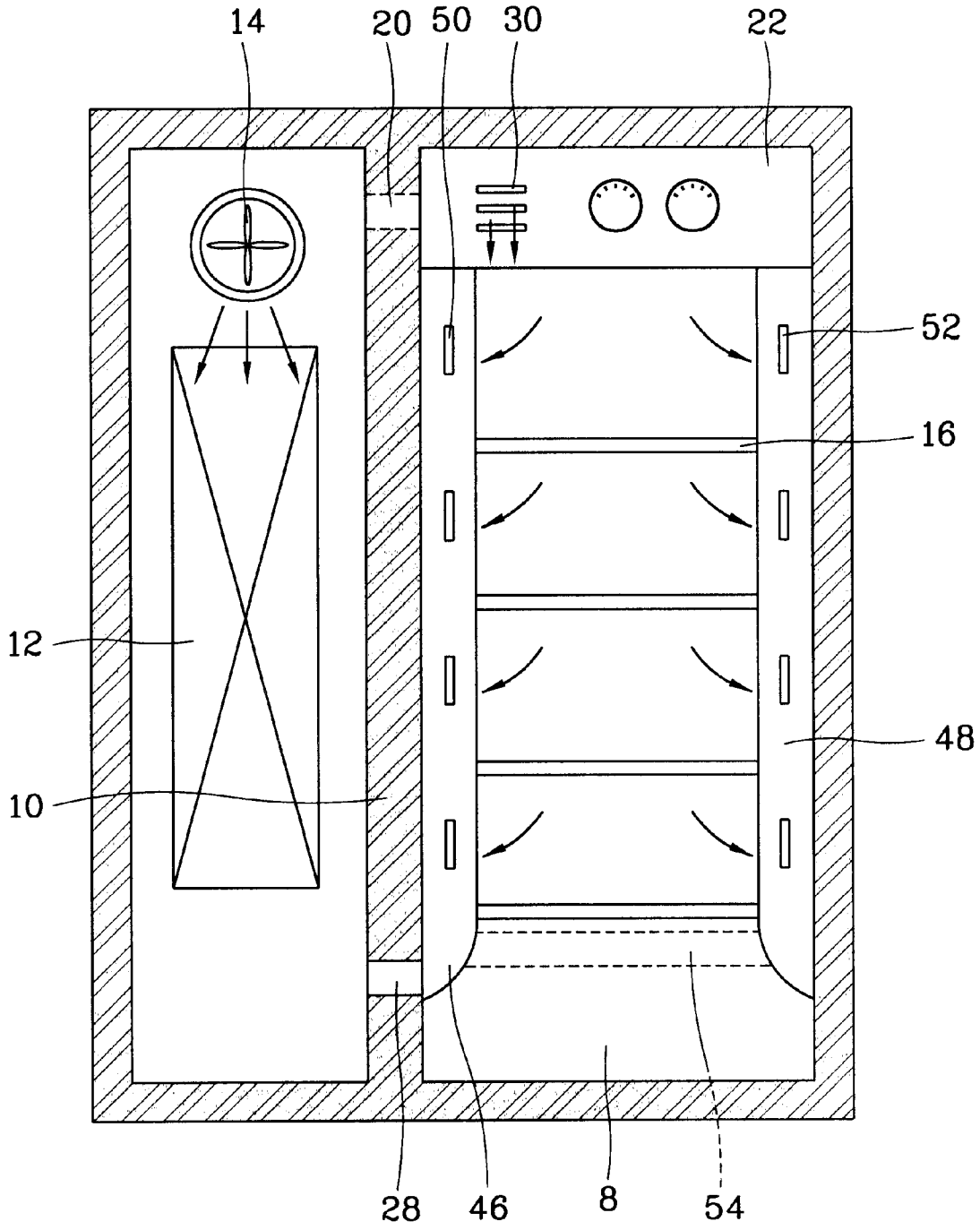
FIG. 7 is a horizontal sectional view showing a cooling air circulating device of a refrigerator according to a third embodiment of the present invention.

As shown in FIG. 7, in a cooling air circulating device according to a third embodiment, a left cooling air suction duct 46 for sucking up the cooling air into the respective cells is installed on the left wall of the chilling chamber 8. A right cooling air suction duct 48 for sucking up the cooling air into the respective cells is formed on the right wall of the chilling chamber 8.

A plurality of cooling air suction openings 50 for sucking up the cooling air are formed in the left cooling air suction duct 46 on the left side of the chilling chamber 8 in the respective cells divided by the shelves 16. The cooling air guide path 28 formed in the mullion wall 10 is connected to the lower portion of the left cooling air suction duct 46, to thus guide the cooling air sucked up from the chilling chamber to the evaporator 12 of the freezing cycle 12.

A plurality of cooling air suction openings 52 for sucking up the cooling air on the right side of the chilling chamber 8 axe formed in the right cooling air suction duct 48 in the respective cells divided by the shelves 16. A cooling air movement path for moving the cooling air sucked up into the right cooling air suction duct 48 to the cooling air guide duct 28 is formed in the lower portion of the right cooling air suction duct 48.

In the cooling air circulating device according to the third embodiment having the above structure, the cooling air is discharged into the discharge openings 30 of the upper discharge duct 22 and performs the cooling operation while circulating in the chilling chamber 8. The cooling air that completed the cooling operation is sucked up into the cooling air suction openings 50 of the left cooling air suction duct 46 installed on the left side of the chilling chamber 8 and into the cooling air suction openings 52 of the right cooling air suction duct 48 installed in the right side of the chilling chamber and is guided to the evaporator 12 of a freezing system through the cooling air guide duct 28.

Figure 8:
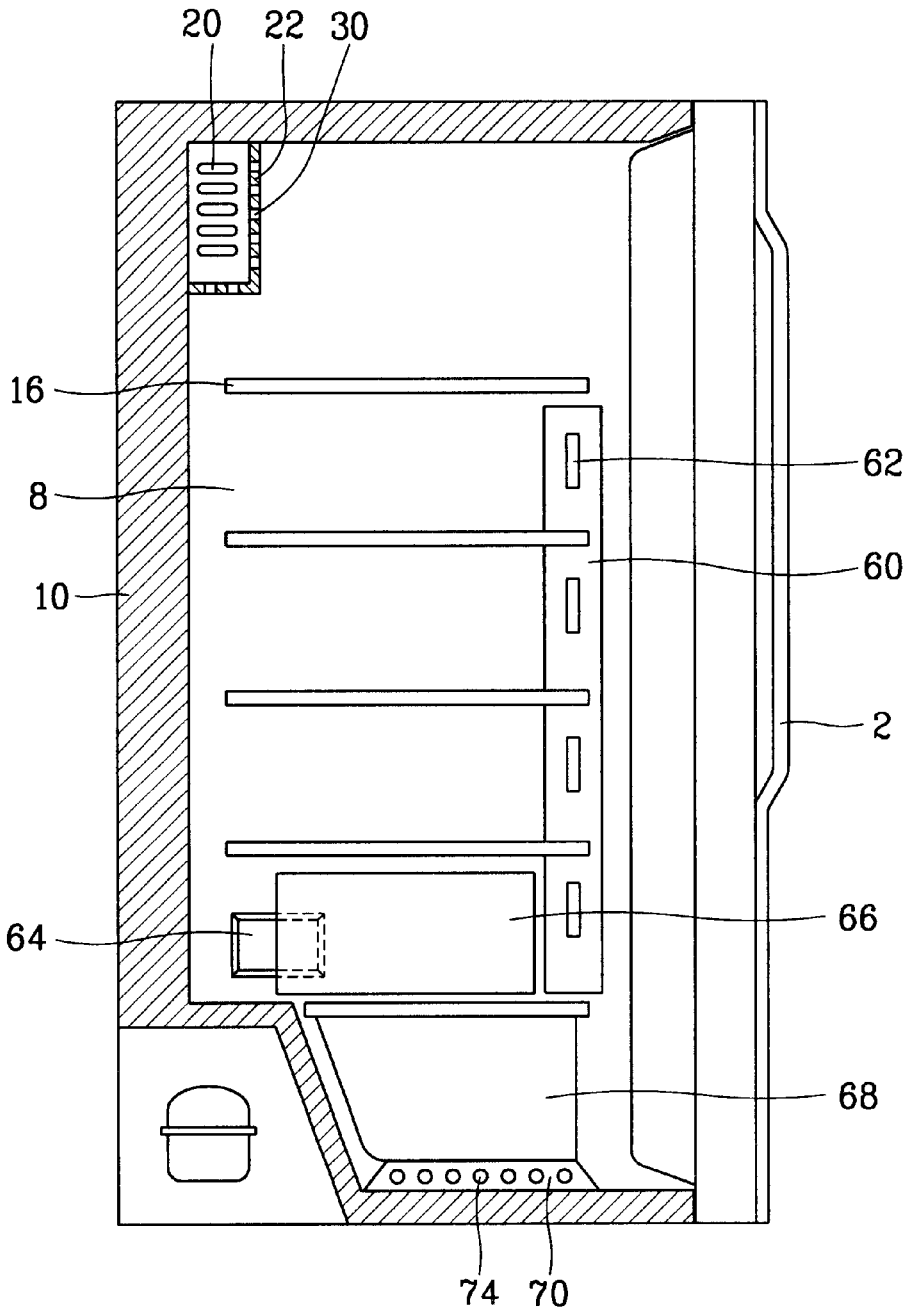
FIG. 8 is a horizontal sectional view showing a cooling air circulating device of a refrigerator according to a fourth embodiment of the present invention.
Figure 9:
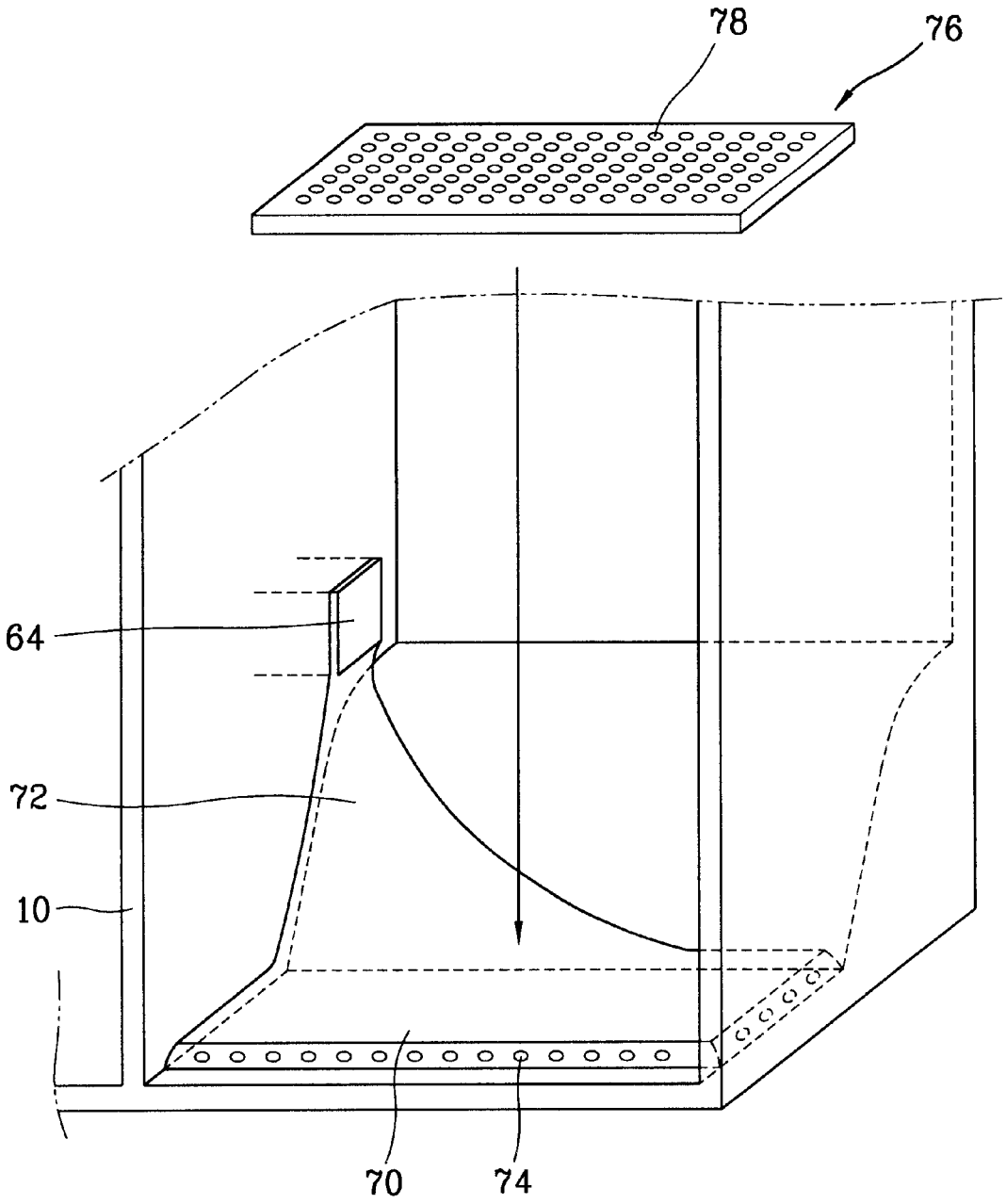
FIG. 9 is a partially cut perspective view showing the cooling circulating device of the refrigerator according to the fourth embodiment of the present invention.

FIG. 8 is a horizontal vertical view showing a cooling air circulating device of a refrigerator according to a fourth embodiment of the present invention. FIG. 9 is a partially cut perspective view showing the cooling air circulating device of the refrigerator according to the fourth embodiment of the present invention.

The cooling air circulating device of the refrigerator according to the fourth embodiment includes the cooling air supply path 20 formed on the upper portion of is the mullion wall 10 so as to supply the cooling air blown from the blast fan to the chilling chamber, the upper discharge duct 22 for sucking up the cooling air supplied to the cooling air supply path 20 and discharging the cooling air into the upper portion of the chilling chamber 8, a side surface discharge duct 60 installed on one or more side of both side surfaces of the chilling chamber 8 and having a plurality of discharge openings 62 for discharging the cooling air into the respective cells, and a cooling air suction unit for sucking up the cooling air discharged from the upper discharge duct 22 and the side surface discharge duct 60.

Vegetable boxes 66 and 68 for storing vegetables are bedded in the lower portion of the chilling chamber 8 by layers. A cooling air guide path 64 for guiding the cooling air that completed the cooling operation of the chilling chamber 8 to the cooling system is formed in the lower portion of the mullion wall 10 that forms one side of the chilling chamber 8.

The cooling air suction unit includes a cooling air suction duct 70 installed on the bottom of the chilling chamber 8, the cooling air suction duct 70 for sucking up the cooling air from the bottom of the chilling chamber and a cooling air movement duct 72 connected between the cooling air suction duct 70 and the cooling air guide path 64, the cooling air movement duct 72 for moving the cooling air sucked up into the cooling air suction duct 70 to the cooling air guide path 64.

The cooling air suction duct 70 is installed on the bottom of the chilling chamber 8 and is formed of flat plates having a predetermined thickness. A space is formed in the cooling air suction duct 70. A plurality of cooling air suction openings 74 for sucking up the cooling air are formed around the cooling air suction duct 70 to be separated from each other by a predetermined distance. The cooling suction duct 70 is a box that can be opened and closed. A deodorant 76 for removing the bad smell of the cooling air is loaded in the cooling air suction duct 70.

The deodorant 76 is a flat plate that can be inserted into the cooling air suction duct 70. A plurality of deodorization holes 78, through which the cooling air sucked up into the cooling air suction duct 70 passes, are formed. The bad smell of the cooling air is removed while passing through the deodorization holes 78.

The cooling air movement duct 72 is integrally connected to the upper surface of the cooling air suction duct 70 and is connected to the cooling air guide path 64. The cooling air movement duct 72 moves the cooling air sucked up into the cooling air suction openings 74 of the cooling air suction duct to the cooling air guide path 64.

Figure 10:
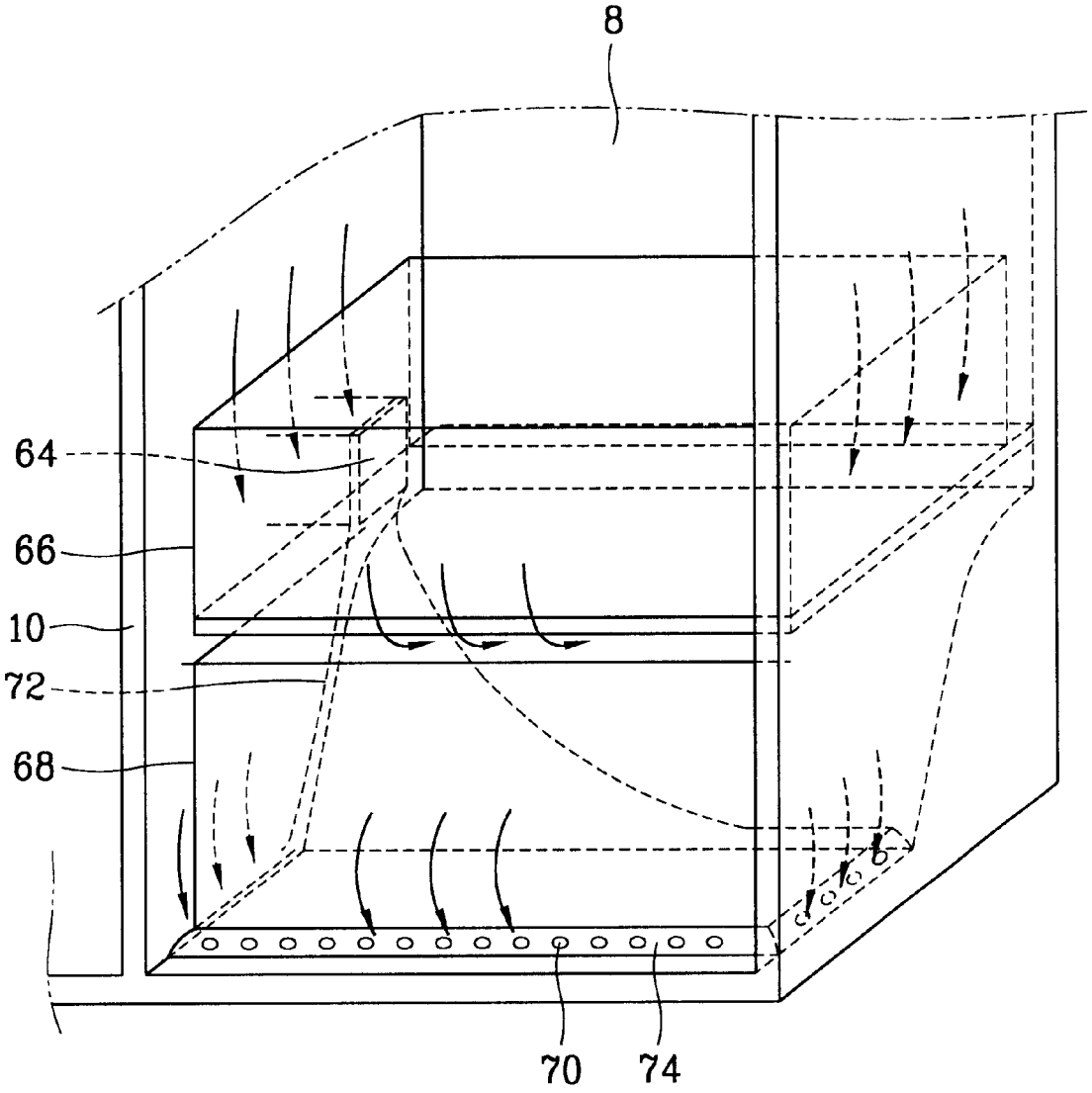
FIG. 10 shows the operation of the cooling air circulating device of the refrigerator according to the fourth embodiment of the present invention.

As shown in FIG. 10, in the cooling air circulating device according to the fourth embodiment, when the cooling air is supplied to the upper discharge duct 22, the cooling air is discharged from the upper discharge duct 22 into the upper portion of the chilling chamber 8. The cooling air is discharged from the side surface of the chilling chamber 8 through the discharge openings 62 of the side surface discharge duct.

The cooling air discharged into the chilling chamber 8 completes the cooling operation while circulating in the chilling chamber 8 and is sucked up into the cooling air suction openings 74 of the cooling air suction duct 70. After the bad smell of the cooling air is removed while passing through the deodorant 76 installed in the cooling air suction duct 70, the cooling air is moved to the cooling air movement duct 72 and is sucked up into the freezing cycle through the cooling air guide path 64.

Since the cooling air suction duct 70 is arranged on the bottom of the chilling chamber 8 and the cooling air suction openings 74 are formed around the cooling air suction duct 70, the cooling air is moved to the bottom of the chilling chamber. After the cooling air cools the vegetable box while circulating in the vegetable boxes 66 and 68 for storing the vegetables, the cooling air is sucked up into the cooling air suction duct 70.

Since the deodorant 76 is loaded all over the cooling air suction duct 70, a larger amount of air passes through the deodorant during the same time. Accordingly, the cooling air is more smoothly deodorized.

Figure 11:
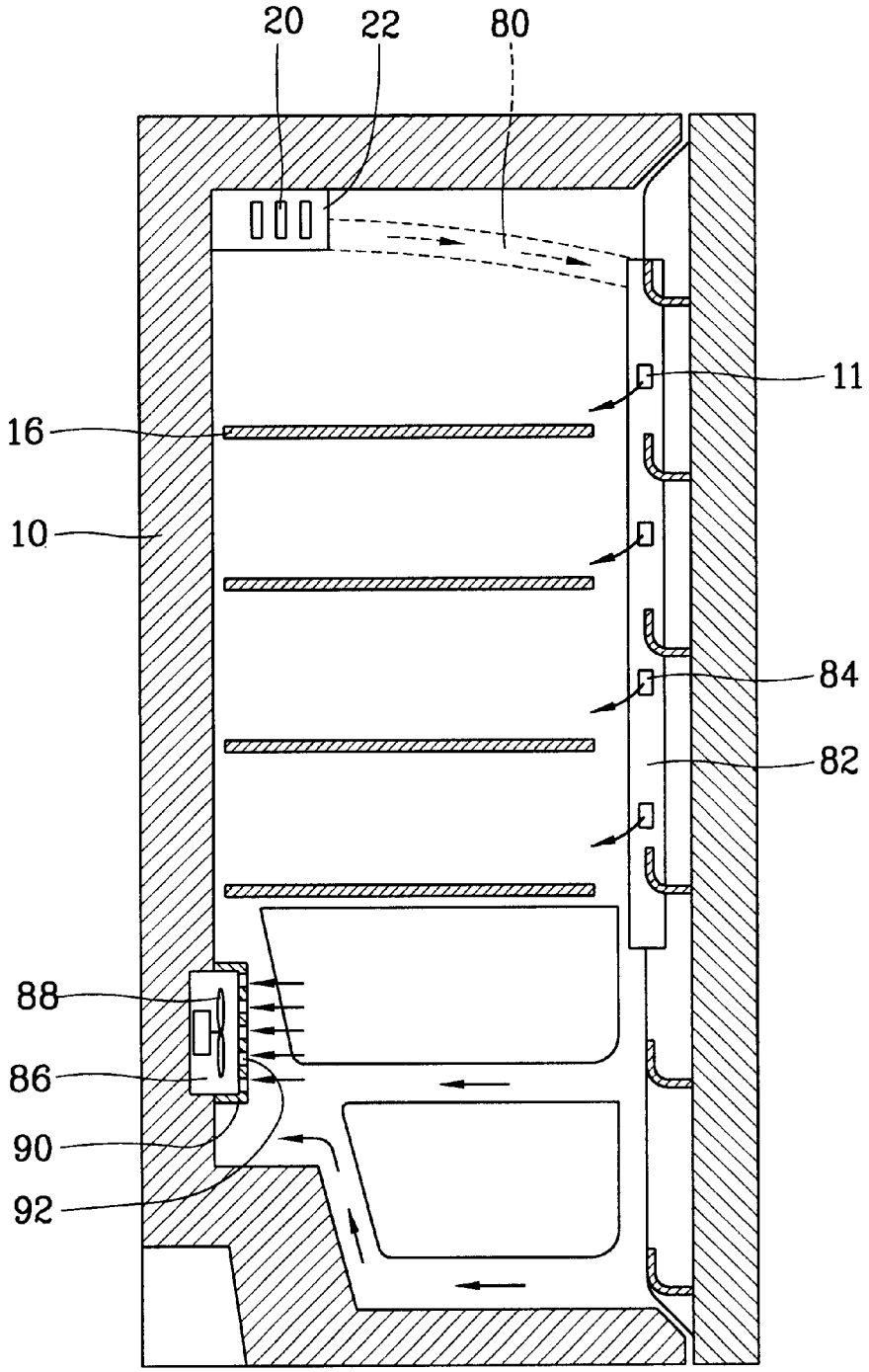
FIG. 11 is a horizontal sectional view showing a cooling air circulating device of a refrigerator according to a fifth embodiment of the present invention.

FIG. 11 is a horizontal sectional view showing a cooling air circulating device of a refrigerator according to a fifth embodiment of the present invention.

The cooling air circulating device of the refrigerator according to the fifth embodiment includes the cooling air supply path 20 formed in the upper portion of the mullion wall 10 for separating the freezing chamber 6 from the chilling chamber 8, the cooling air supply path 20 for supplying the cooling air to the chilling chamber 8, the upper discharge duct 22 connected to the cooling air supply path 20 and installed in the upper portion of the chilling chamber 8, the upper discharge duct 22 for discharging the cooling air into the upper portion of the chilling chamber 8, a side surface discharge duct 82 connected to the upper discharge duct 22 and a cooling air guide channel 80, loaded on the side surface of the chilling chamber 8, and having a plurality of discharge openings 84 for discharging the cooling air into the respective cells divided by the shelves 16 on the side surface of the chilling chamber 8, a cooling air suction path 86 for sucking up the cooling air that completed the cooling operation while circulating in the chilling chamber 8, and a suction unit installed on the cooling air suction path 86, the suction unit for providing a suction pressure so that the cooling air can be smoothly sucked up.

The cooling air suction path 86 is formed in the lower portion of the mullion wall 10 and sucks up the cooling air. A predetermined space, in which the suction unit can be loaded, is provided in the cooling air suction path 86.

The suction unit is for rapidly discharging the cooling air that completed the cooling operation while circulating in the chilling chamber 8 by providing the suction pressure when the cooling air is sucked up into the cooling air suction path 86. The suction unit is preferably formed of a suction fan 88 loaded on one side of the cooling air suction path 86. A cover plate 90 having a plurality of suction holes 92 is arranged in the front portion of the suction fan 88.

In the cooling air circulating device of the refrigerator according to the fifth embodiment, the cooling air is discharged from the upper portion and the side surface of the chilling chamber 8 through the upper discharge duct 22 and the side surface discharge duct 82. The cooling air performs the cooling operation while circulating in the chilling chamber 8. The cooling air that completed the cooling operation is sucked up into the cooling air suction path 86 formed in the lower portion of the mullion wall.

At this time, the suction fan 88 installed in the cooling air suction path 86 is driven so that the cooling air that completed the cooling operation can be rapidly sucked up.

Figure 12:
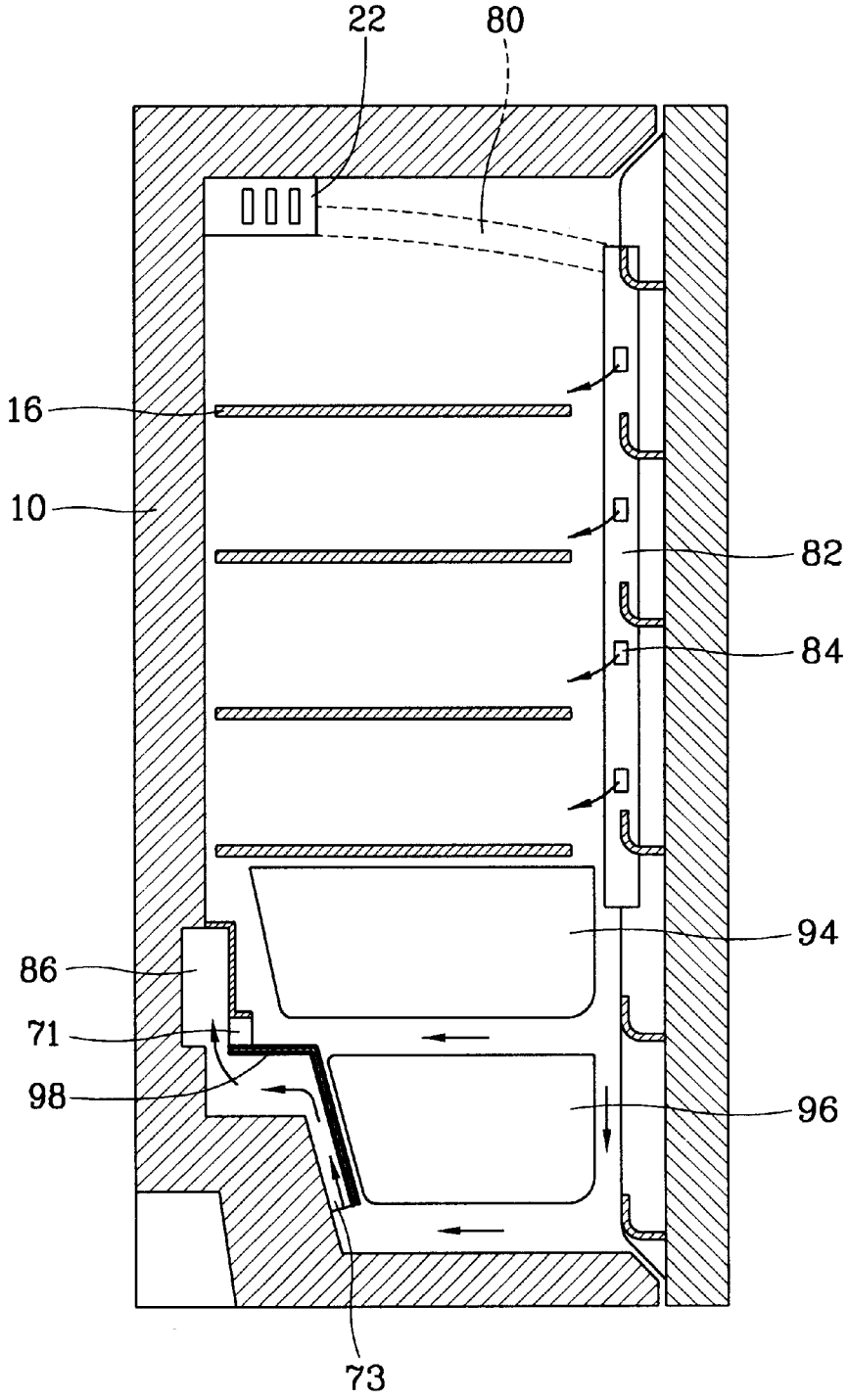
FIG. 12 is a horizontal sectional view showing a cooling air circulating device of a refrigerator according to a sixth embodiment of the present invention.

FIG. 12 is a sectional view of a cooling air circulating device of a refrigerator according to a sixth embodiment of the present invention.

As shown in FIG. 12, the cooling air circulating device according to the sixth embodiment includes the upper discharge duct installed in the upper portion is of the chilling chamber so as to discharge the cooling air from the upper portion of the chilling chamber, the side surface discharge duct 82 installed on the side surface of the chilling chamber 8, the side surface discharge duct 82 for discharging the cooling air into the side of the chilling chamber, the cooling air suction path 86 formed in the lower portion of the mullion wall 10, the cooling air suction path 86 for sucking up the cooling air that completed the cooling operation, and a cooling air guide unit on the cooling air suction path 86 for guiding the flow of the cooling air so that the cooling air can be sucked up into the cooling air suction path 86 via vegetable boxes 94 and 96.

Here, a plurality of vegetable boxes for storing vegetables are bedded by layer in the lower portion of the chilling chamber 8. For example, when two vegetable boxes are bedded, a first vegetable box 94 is bedded in the upper portion and a second vegetable box 96 is bedded in the lower portion.

The guide unit includes a cooling air guide duct 98 extended from the front side of the cooling air suction path 86, the cooling air guide duct 98 for guiding the direction, in which the cooling air is sucked up, so that the cooling air can circulate around the vegetable boxes 94 and 96.

Here, in the cooling air guide duct 98, a first suction opening 71 for sucking up the cooling air that circulates around the first vegetable box 94 is formed in a predetermined position between the first vegetable box 94 and the second vegetable box 96. A second suction opening 73 for sucking up the cooling air that circulates around the second vegetable box 96 positioned in the lower most portion of the chilling chamber 8 is formed in a position close to the bottom of the chilling chamber 8.

In the cooling air circulating device according to the sixth embodiment, the cooling air discharged from the upper discharge duct 22 and the side surface discharge duct 82 into the chilling chamber 8 performs the cooling operation while circulating in the chilling chamber and moves to the lower portion. At this time, some of the cooling air cools the first vegetable box 94 while circulating around the first vegetable box 94, is sucked up into the first suction opening 71, and moves to the cooling cycle through the cooling air suction path 86. Some of the cooling air cools the second vegetable box 96 while circulating around the second vegetable box 96, is sucked up into the second suction opening 73, and moves to the cooling cycle through the cooling air suction path 86.

Figure 13:
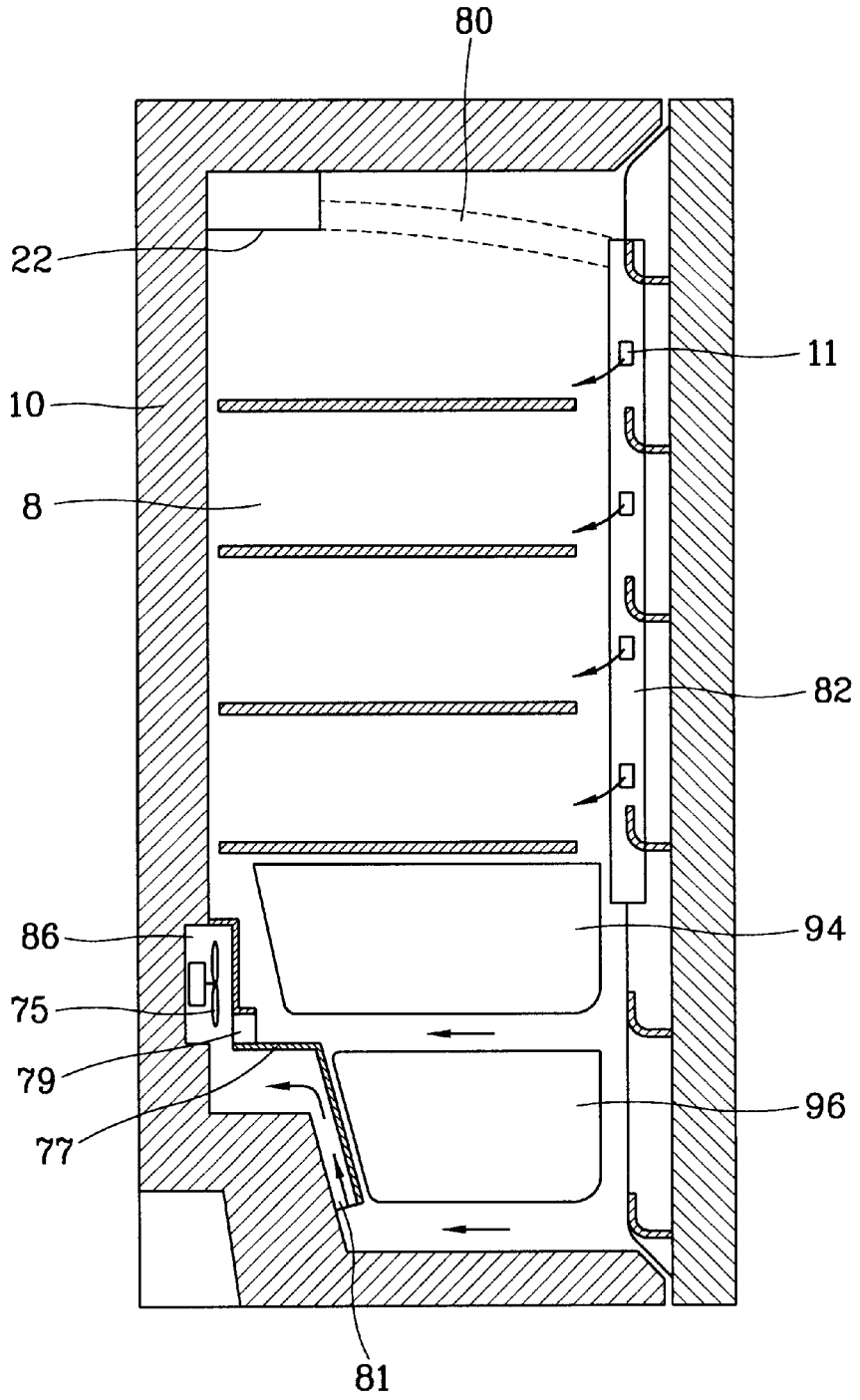
FIG. 13 is a horizontal sectional view showing a cooling air circulating device of a refrigerator according to a seventh embodiment of the present invention.

FIG. 13 is a sectional view showing a cooling air circulating device of a refrigerator according to a seventh embodiment of the present invention.

As shown in FIG. 13, the cooling air circulating device of the refrigerator according to the seventh embodiment includes the cooling air supply path 20 formed in the upper portion of the mullion wall 10 for separating the freezing chamber from the chilling chamber, the cooling air supply path 20 for supplying the cooling air to the chilling chamber 8, the upper discharge duct 22 connected to the cooling air supply path 20 and loaded in the upper portion of the chilling chamber 8, the upper discharge duct 22 for discharging the cooling air to the upper portion of the chilling chamber 8, the side surface discharge duct 82 connected to the upper discharge duct 22 and the cooling air guide channel 80 and loaded on the side surface of the chilling chamber, the side surface discharge duct 82 for discharging the cooling air from the side surface of the chilling chamber into the respective cells divided by the shelves, the cooling air suction path 86 for sucking up the cooling air that completed the cooling operation while passing through the chilling chamber 8, a suction fan 75 installed in the suction path 86, the suction fan 75 for providing a suction pressure so that the cooling air can be smoothly sucked up, and a cooling air guide duct 77 installed in the front portion of the cooling air suction path 86, the cooling air guide duct 77 for guiding the flow of the cooling air.

The suction fan 75 has the same structure and operation as those of the above-mentioned suction fan 88 of the fifth embodiment. The cooling air guide duct 77 has the same structure and operation as those of the above mentioned cooling air guide duct 98 of the sixth embodiment. Therefore, description of the structures and operations of the suction fan 75 and the cooling air guide duct 77 will be omitted.

In the cooling air circulating device according to the seventh embodiment, the cooling air is discharged from the upper portion and the side surface of the chilling chamber 8 through the upper discharge duct 22 and the side surface discharge duct 82, performs the cooling operation while circulating in the chilling chamber 8, and moves to the lower portion.

At this time, some of the cooling air cools the first vegetable box 94 while circulating around the first vegetable box 94, is sucked up into the first suction opening 79, and moves to the cooling cycle through the cooling air suction path 86. Some of the cooling air cools the second vegetable box 96 while circulating around the second vegetable box 96, is sucked up into the second suction opening 81, and moves to the cooling cycle through the cooling air suction path 86. The cooling air sucked up into the cooling air suction path 86 s rapidly sucked up due to the suction pressure of the suction fan 75.

The effect of the cooling air circulating device according to the present invention, which has the above structure and operation will now be described.

It is possible to impartially cool the chilling chamber and make the spread of temperature of the chilling chamber uniform by installing one or more cooling suction ducts on the side surface of the chilling chamber and forming a plurality of suction openings for sucking up the cooling air in the respective shelves divided by the shelves in the cooling air suction duct.

Also, it is possible to rapidly cool the chilling chamber and to reduce the time for cooling the chilling chamber by letting the respective cells of the chilling chamber suck up the cooling air, to thus minimize the time, for which the cooling air whose temperature has risen above a predetermined temperature stays in the chilling chamber.

Also, it is possible to smoothly cool the vegetable boxes by installing the cooling air suction duct on the bottom of the refrigerator, to thus let the cooling air sucked up around the chilling chamber in the lower portion of the chilling chamber and to thus let the cooling air sucked up around the vegetable boxes.

Also, it is possible to improve deodorization effect by increasing the area of the deodorant arranged in the cooling air suction duct, to thus increase the suction amount of the cooling air.

Also, it is possible to rapidly suck up the cooling air and to maintain balance between the supply of the cooling air and the suction of the cooling air so that the cooling air smoothly circulates by installing the suction unit for providing the suction pressure to the cooling air sucked up into the cooling air suction duct.

What is claimed is:

1. A cooling air circulating device of a refrigerator, comprising:

a cooling air supply path formed in an upper portion of a mullion wall for separating a freezing chamber from a chilling chamber, the cooling air supply path for supplying cooling air to the chilling chamber;

a cooling air discharge duct connected to the cooling air supply path and formed at one side of the chilling chamber along a longitudinal direction thereof, for discharging the cooling air to the chilling chamber; and a cooling air suction duct formed on one or more surfaces of the chilling, chamber along a longitudinal direction thereof, the cooling air suction duct having a plurality of suction openings extending along a length thereof for sucking up the cooling air that completed a cooling operation while circulating in the chilling chamber; and a cooling air guide path connected to the cooling air suction duct, for guiding the cooling air that has completed a cooling operation to an evaporator for a freezing operation.

2. The cooling air circulating device of claim 1, further comprising:

a side surface discharge duct connected to the cooling air discharge duct and vertically installed on a first side of the chilling chamber, the side surface discharge duct for discharging the cooling air into respective cells divided by shelves wherein the cooling air suction duct is vertically installed on a second side of the chilling chamber and sucks up the cooling air from the respective cells divided by the shelves.

3. The cooling air circulating device of claim 1, wherein the cooling air suction duct comprises cooling air suction ducts connected to the upper discharge duct and vertically installed on left and right surfaces of the chilling chamber, the cooling air suction ducts for sucking up the cooling air from respective cells divided by shelves.

4. The cooling air circulating device of claim 1, wherein the cooling air suction duct is vertically formed on the side surface of the chilling chamber and a plurality of cooling air suction openings are formed in the cooling air suction duct to be separated from each other by a predetermined distance so that the cooling air can be sucked up into the respective cells divided by the shelves.

5. The cooling air circulating device of claim 1, further comprising:

a cooling air suction path for sucking up the cooling air that completed has completed a cooling operation while circulating in the chilling chamber; and a suction unit installed on the cooling air suction path, the suction unit for providing a suction pressure so that the cooling air can be smoothly sucked up.

6. The cooling air circulating device of claim 5, wherein the suction unit is formed of a suction fan for providing the suction pressure when the cooling air that completed the cooling operation while circulating in the chilling chamber is sucked up into the cooling air suction path.

7. The cooling air circulating device of claim 1, further comprising:

a cooling air suction path for sucking up the cooling air that completed a cooling operation while circulating in the chilling chamber; and a cooling air guide unit formed on the cooling air suction path, the cooling air guide unit for guiding the flow of the cooling air so that the cooling air can be sucked up into the cooling air suction path via vegetable boxes.

8. The cooling air circulating device of claim 7, wherein the cooling air guide unit is formed of a cooling air guide duct extended from the front portion of the cooling air suction path, the cooling air guide duct for guiding the direction, in which the cooling air is sucked up, so that the cooling air can circulate around the vegetable boxes.

9. The cooling air circulating device of claim 8, wherein the cooling air guide duct comprises:

a first suction opening formed between the vegetable boxes so that the cooling air circulating around the vegetable box positioned in the upper portion is sucked up; and a second suction opening formed in a position close to the bottom of the chilling chamber so that the cooling air circulating around the vegetable box positioned in the lower most portion of the chilling chamber is sucked up.

10. The cooling air circulating device of claim 1, further comprising:

a cooling air suction path for sucking up the cooling air that completed a cooling operation while circulating in the chilling chamber;

a cooling air suction duct formed in a front portion of the cooling air suction path, the cooling air suction duct for guiding the flow of the cooling air so that the cooling air can be sucked up into the cooling air suction path via vegetable boxes; and a suction fan loaded in the cooling air suction path, the suction fan for providing suction pressure to the sucked cooling air.

11. A refrigerator comprising the cooling air circulating device of claim 1.

12. A cooling air circulating device of a refrigerator, comprising:

a cooling air supply path formed in an upper portion of a mullion wall for separating a freezing chamber from a chilling chamber, the cooling air supply path for supplying cooling air to the chilling chamber;

an upper discharge duct connected to the cooling air supply path and installed in the upper portion of the chilling chamber, the upper discharge duct for discharging the cooling air from the upper portion of the chilling chamber;

a side surface discharge duct connected to the upper discharge duct and vertically installed on a first side surface of the chilling chamber, the side surface discharge duct for discharging the cooling air into respective cells divided by shelves; and a cooling air suction duct vertically installed on a second side surface of the chilling chamber, the cooling air suction duct having a plurality of suction openings extending along a length thereof for sucking up the cooling air from the respective cells divided by the shelves.

13. The cooling air circulating device of claim 12, wherein a cooling air movement path for moving the cooling air sucked up into the cooling air suction openings to the cooling air guide path is connected in the lower portion of the cooling air suction duct.

14. A refrigerator comprising the cooling air circulating device of claim 12.

15. A cooling air circulating device of a refrigerator, comprising:

a cooling air supply path formed in an upper portion of a mullion wall so as to supply cooling air to a chilling chamber;

a discharge duct for discharging the cooling air supplied from the cooling air supply path into the chilling chamber;

a cooling air suction unit installed on the bottom of the chilling chamber, the cooling air suction unit for sucking up the cooling air discharged from the discharge duct via vegetable boxes; and a cooling air guide path for guiding the cooling air sucked up into the cooling air suction unit to a freezing cycle, wherein the cooling air suction unit is installed on a bottom surface of the chilling chamber and is formed of a substantially flat plate type cooling air suction duct on which are formed a plurality of cooling air suction openings for sucking up the cooling air.

16. The cooling air circulating device of claim 15, wherein a cooling air movement duct connected to the cooling air guide path, the cooling air movement duct for moving the cooling air sucked up into the cooling air suction duct to the cooling air guide path is formed in the upper portion of the cooling air suction duct.

17. The cooling air circulating device of claim 15, wherein the cooling air suction duct is formed of a box that can be opened and closed and a deodorant for removing a bad smell of the cooling air is loaded in the cooling air suction duct.

18. The cooling air circulating device of claim 17, wherein the deodorant is formed in a predetermined flat plate type so that the deodorant can be settled in the cooling air suction duct and a plurality of through holes, through which the cooling air sucked up into the cooling air suction duct passes and is deodorized, are formed in the deodorant.

19. A refrigerator comprising the cooling air circulating device of claim 15.

* * * * *